United States Patent [19]

Olson

[11] 4,253,379

[45] Mar. 3, 1981

[54] FLUID CONTROL SYSTEM

[75] Inventor: Paul E. Olson, Lexington, Ky.

[73] Assignee: American Standard Inc., New York, N.Y.

[21] Appl. No.: 80,834

[22] Filed: Oct. 1, 1979

[51] Int. Cl.[3] ..... F15B 21/02

[52] U.S. Cl. ..... 91/35; 91/443; 91/446; 91/533; 137/884

[58] Field of Search ..... 91/443, 533, 447, 448, 91/38, 40, 39, 446, 35; 137/884

[56] References Cited

U.S. PATENT DOCUMENTS

| | | | |
|---|---|---|---|
| 2,619,073 | 11/1952 | Brooks | 91/38 |
| 3,213,886 | 10/1965 | Pearne | 91/443 |
| 3,654,960 | 4/1972 | Kiernan | 137/884 |
| 3,752,040 | 8/1973 | Pawloski | 91/533 |
| 4,066,004 | 1/1978 | Alcalay | 91/447 |
| 4,099,450 | 7/1978 | Mase | 91/447 |
| 4,195,552 | 4/1980 | Neff | 91/443 |

OTHER PUBLICATIONS

Hydraulics & Pneumatics vol. 16 No. 6, J. C. Grimstad p. 77.

*Primary Examiner*—Abraham Hershkovitz
*Attorney, Agent, or Firm*—Robert G. Crooks; John P. Sinnott; James J. Salerno, Jr.

[57] ABSTRACT

This invention relates to a pneumatic cylinder and valve control system in which a block and two plates bolted to the block form one end of the cylinder. This block and plate combination, moreover, provides the housing for the valves and conduits that comprise the pneumatic control system for the operation of the cylinder. To produce greater force, moreover, two pistons mounted within the cylinder on the same line of action both are in fluid communication with the pneumatic control system.

4 Claims, 7 Drawing Figures

FLUID CONTROL SYSTEM

This invention relates to fluid control systems and, more particularly, to a combination of valves for controlling the operation of a fluid power piston and cylinder, and the like.

Valve systems for controlling the operation of various actuating mechanisms, of which the pneumatically or hydraulically activated piston and cylinder combination are typical, have been used for a number of years. Illustratively, door opening mechanisms for use in hospitals, convalescent facilities, nursing homes, retail merchandising stores and similar establishments use these valve systems to enable doors to swing open and then to close automatically with minimal exertion on the part of the person who wishes to pass through the doorway. This is particularly important when dealing with heavy fire doors or "primary" doors and with people who may be burdened with parcels, old or infirm.

Basically, these door opening systems combine a conventional hydraulic retarding type door closing apparatus with a pneumatically activated piston and cylinder combination for pushing the door open. The initial impetus must be small for causing the door opening piston and cylinder to commence operation. The cylinder and piston must press the door to a full-open condition and keep the door in that condition for a sufficiently long period of time to permit passage through the doorway. Naturally, the door should not close on the person or material passing through the doorway, nor should the door remain open too long and allow heat to be lost to the atmosphere, insects to enter the building or similar undesirable results.

Door opener timing, that is, the speed with which it will swing open and the length of time that the door will remain open, necessarily must vary according to the circumstances of a particular application. Consequently, to be commercially acceptable, a door opening device should have an adjustable timing feature that would provide an individual control for the door opening speed and the length of time during which the door will remain open. In this manner, one general commercial device can be used in any number of applications, the timing being trimmed to suit individual needs.

There is, of course, a continuing requirement to improve products of this nature, to make them less expensive without sacrificing quality or reliability, and to enhance their appearance in order to make them more acceptable to architects and builders. It would be even more satisfying and useful if, in the course of this product improvement, the result is a device that enjoys superior reliability.

In the past, one type of door opener piston and cylinder combination was mounted on a flat plate attached to the door in question. The valves regulating the door opener timing were secured to the plate and coupled to the pneumatic system by means of tubes that were individually cut and manually secured in place. Not only was this technique expensive, but it also presented a number of quality assurance problems with respect to joints, connections, and the like. Further in this regard, this assemblage of valves and cylinders, even when covered with an appealing housing, was quite bulky and therefore was not entirely satisfactory from an architectural viewpoint.

These and other problems that have characterized the prior art are overcome, to a great extent, through the practice of the invention. Typically, the valves that control the door opener timing all are formed in an integral plate and block assembly that forms one part of the pneumatic cylinder. In this way, the valve system not only is much more compact but the cost of manual assembly and the quality assurance difficulties that were inherent in the prior art are overcome. Quality assurance, moreover, is significantly improved because the integral plate and block assembly sharply reduces the chance for leaking connections between valves.

To provide the needed door opening force, the piston and cylinder to which the integral plate and block assembly is attached actually accommodate two pistons in one cylinder, both of these pistons being spaced longitudinally from each other and mounted in parallel with coincident lines of action. In this manner, with all other things being equal, one cylinder is able to provide just slightly less than twice as much force as a conventional cylinder and piston set. The effect of this improvement is to produce a slimmer, less bulky device that is much more attractive, and hence, is more acceptable to architects and builders.

There are a number of further improvements that characterize the invention. Thus, the adjustment controls for the door opening speed and the time during which the door will remain in the fully open position protrude from the integral plate and block assembly in a direction that is perpendicular to the door surface on which the entire device is mounted. This feature of the invention makes access for timing adjustment and readjustment quite easy.

These and other features of the invention will be more fully appreciated through the following description of a specific embodiment of the invention. The scope of the invention, however, is limited only through the claims.

Figure 1:
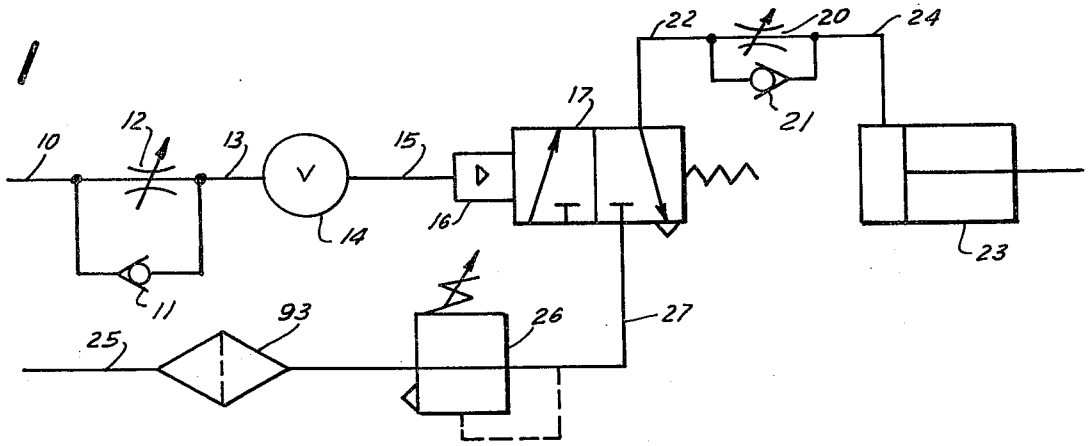
FIG. 1 is a schematic diagram of a typical pneumatic control system illustrating features of the invention.
Figure 3:
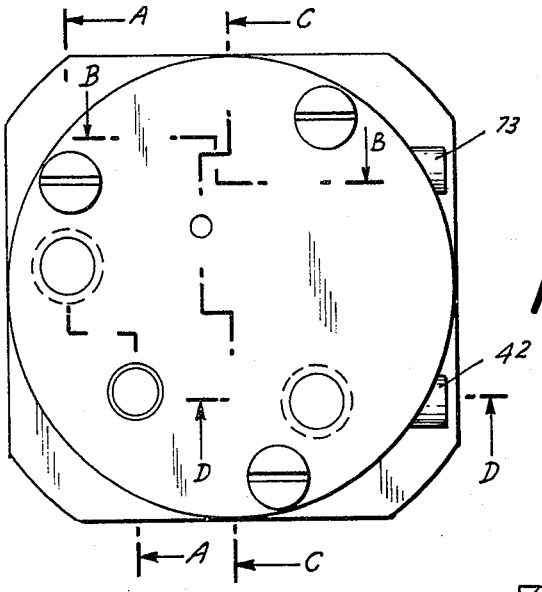
FIG. 3 is a side elevation of the device shown in FIG. 2.
Figure 6:
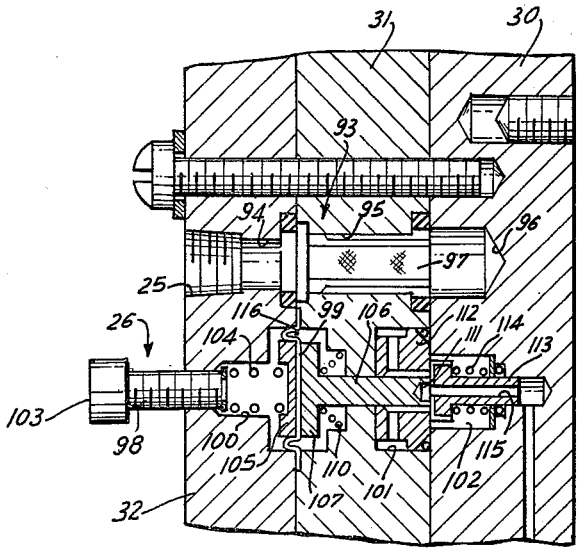
Figure 7:
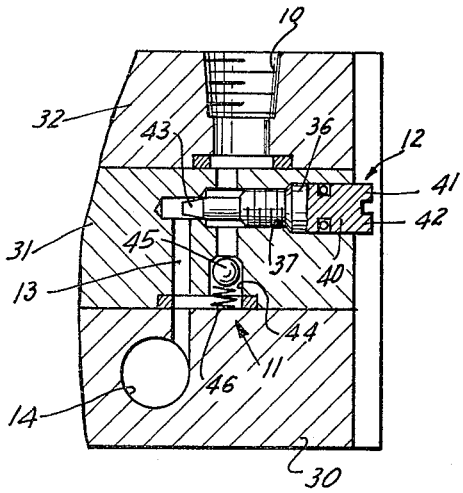

FIG. 6 is a side elevation in full section of a filter and regulator, taken along the line A—A of FIG. 3, and viewed in the direction of the arrows; and FIG. 7 is a side elevation in full section of a timing needle valve and a check valve, taken along the line D—D of FIG. 3, and viewed in the direction of the arrows; and For a more complete understanding of the invention, attention is invited to FIG. 1. An initial impulse or brief pulse of compressed air or other suitable fluid is admitted to a conduit 10 from a wall button or the like (not shown in the drawing) that is activated through an application of a small opening pressure or signal to a door (also not shown in the drawing). The conduit 10 communicates with a parallel connected check valve 11 and choke 12.

The check valve 11 and the choke 12 are both coupled through a conduit 13 to a pneumatic pressure accumulator 14. A conduit 15 connects the pressure accumulator 14 to a pilot valve 16. As illustrated in the drawing, the pilot valve 16 regulates the operation of a control valve 17. In turn, the control valve 17 is connected in fluid communication with another parallel connected choke 20 and check valve 21 through a conduit 22.

Particular note should be made of the flow orientations of the check valve 11 and the check valve 21. Thus, air flows through the check valve 11 only toward the pilot valve 16 of control valve 17. System air, moreover, flows through the check valve 21 only toward the control valve 17.

The choke 20 and the check valve 21 are both coupled to the interior of a pneumatic cylinder 23 through a conduit 24.

A compressed air supply is connected to the system by means of a conduit 25. Preferably, the air supply should not be less than 20 pounds per square inch (psi). The compressed air then is admitted to the system through a pressure regulating valve 26 and through a conduit 27 to the control valve 17.

Figure 2:
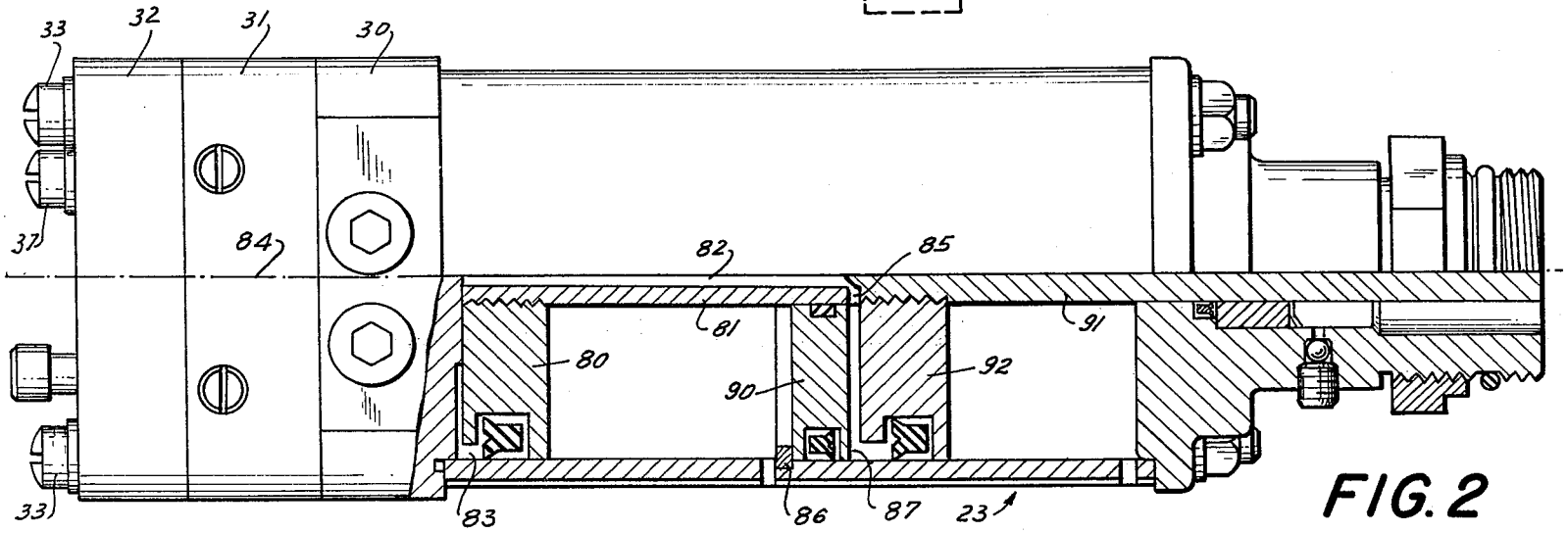
FIG. 2 is a front elevation in partial section of a cylinder and pistons door opener assembly with an attached integral valve combination that embodies the system shown in FIG. 1.

For a more detailed description of the logic valves that form this system, attention now is invited to FIG. 2 which shows, in accordance with a salient feature of the invention, an integral block 30 that forms one of the transverse ends of the pneumatic cylinder 23. A pair of parallel and overlaying plates 31, 32 are securely fastened to the block 30 by means of screws 33, or the like. The block 30 and the plates 31, 32 have recesses and cavities formed in their respective structures which, when properly joined together, form the housings for the valves, chokes, pressure accumulator and conduits described in connection with FIG. 1.

Attention now is invited to FIG. 7, which shows the conduit 10 that admits an initial pulse of air under pressure to activate the system from a door valve, or the like (not shown in the drawing). As previously mentioned, the conduit 10 establishes fluid communication for this pulse with a parallel combination of the choke 12 and the check valve 11.

In FIG. 7, it can be seen that a housing 36 for the choke 12 is formed by means of a bore in the plate 31 that penetrates the longitudinal exposed side of that plate. A threaded portion 37 of the bore mates with a corresponding threaded portion on a choke valve stem 40. The choke valve stem 40 has a shaft 41 that is sealably contained in and protrudes out of the longitudinal side of the plate 31 and terminates in a slotted head 42 that can accommodate a screw driver or the like for valve adjustment as described subsequently in more complete detail.

Continuing with the description of the choke valve stem 40, it should be noted that the end of the stem which is lodged within the choke housing 36 terminates in the frustrum of a cone 43. The threading 37 permits the gap between the choke housing 36 and the conical termination 43 of the valve stem 40 to be selectively varied in area, thereby impeding or promoting the flow of the pulse from the conduit 13 to the door valve.

The check valve 11 communicates with the conduit 10 by way of an enlarged chamber that surrounds a portion of the choke valve stem 40 that is adjacent to the conical termination 43 of the stem. A longitudinal bore in the plate 31 forms a check valve housing 44. A ball 45 that is seated in one end of a coil spring 46 is pressed against the valve seat in the check valve housing 44. The spring 46, in turn, bears against the surface of the integral block 30 that is adjacent to the plate 31.

As noted above, the check valve 11 permits fluid communication for the initiating pulse of air to flow into the conduit 13.

The conduit 13 is coupled to a pressure accumulator 14.

Figure 5:
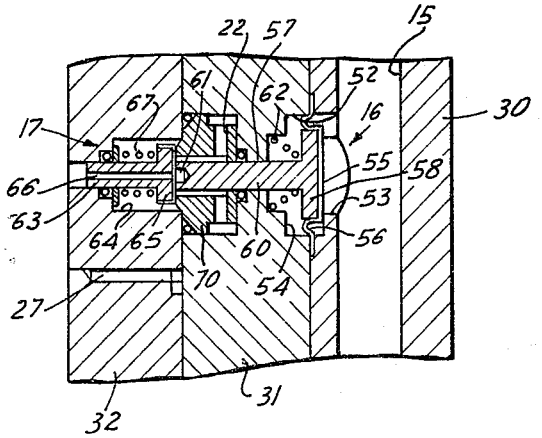
FIG. 5 is a side elevation in full section of a control valve, taken along the line C—C of FIG. 3, and viewed in the direction of the arrows.

The pressure accumulator communicates through the conduit 15, which is formed in the integral block 30, with the pilot valve 16 (FIG. 5). The pilot valve 16 has a housing 52 that is formed by means of bores 53, 54 that are formed in the integral block 30 and the plate 31. A thin diaphragm 55 is clasped between the block 30 and the plate 31 at their common interface in order to establish a partition between the bores 53 and 54 that form the housing for the pilot valve 16. Note that the diaphragm 55 has a peripheral corrugation 56 that imparts a certain degree of resiliency to the diaphragm.

A pilot valve stem 57 is lodged within the bore 54. The valve stem 57 has a flat head 58 that abuts the diaphragm 55 and a shank 60 that is supported for longitudinal sliding motion in a reduced diameter portion of the bore 54. In the end of the shank 60, a shallow longitudinal cavity 61 is used to form an exhaust valve seat. A spiral spring 62 that is concentric with the longitudinal axis of the shank 60 presses the flat head 58 of the stem against the diaphragm 55.

The valve seat end of the shank 60 abuts a control valve stem 63 when conduit 15 and diaphragm 55 are pressurized. Further in this regard, the control valve stem 63 is sealably retained in a bore 64 formed in the plate 32 that provides the housing for the control valve 17. Not only does this control valve stem 63 have a flat head 65 that abuts the end of the shank 60 and supply seat 70, but the stem 63 also has a longitudinally oriented bore 66 that establishes fluid communication between the atmosphere external to the plate 31 and the conduit 22 through the annular cavity formed by the supply seat 70. A coil spring 67 is received on the shank of the control valve stem in order to press the flat head 65 of the control valve stem 63 against supply seat 70 and the end of the pilot valve stem 57.

As shown in the drawing the end of the shank 60 of the pilot valve stem is spaced from the side of the central aperture in an annular supply seat 70 that sealably abuts the plate 32 at the common interface between the plates 31 and 32. The central aperture in the seat 70, however, has a diameter that is somewhat smaller than the diameter of the flat head 65. In this manner, compressed air, or other suitable fluid, which is admitted to the control valve bore 64 by way of the conduit 27, is selectively permitted to flow past the flat head 65 of the control valve stem 63 and into the conduit 22, depending on the longitudinal position of the flat head with respect to the plug 70.

Figure 4:
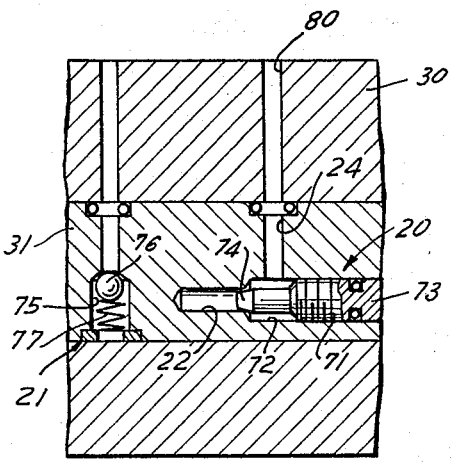
FIG. 4 is a side elevation in full section of a door control needle valve, taken along the line B—B of FIG. 3, and viewed in the direction of the arrows.

As shown in FIG. 4, the conduit 22 establishes fluid communication with the choke 20 and the check valve 21. The choke 20 is similar in construction to the choke 12 described in FIG. 7. Thus, a choke valve stem 71 is engaged in a mating thread that is formed in the choke housing 72. As illustrated in FIG. 4, the choke housing is provided by means of a bore in the plate 31. The bore enters a lateral, or longitudinal side of the plate 31 to allow a slotted head 73 to protrude in parallel with and in the same plane as the slotted head 42, as best shown in FIG. 3. Note particularly in this respect that the knobs 42, 73 protrude from the valve system on a side that is opposite to the plane of the door to which the entire device is to be mounted. These heads further are mounted in a plane that is perpendicular to the door surface that supports the device under consideration.

As shown, the portion of the choke valve stem 71 that is lodged within the plate 31 terminates in the frustrum of a cone 74. This conical termination of the control valve stem 71 permits the gap between the choke housing and the conical surface 74 to be selectively varied in order to regulate the air flow between the conduit 22 and the conduit 24.

The check valve 21, which is coupled in parallel with the choke 20 across the conduits 22 and 24, has a housing 75 that is provided by a small bore in the plate 31. A ball 76 that is seated on a coil spring 77 blocks air from flowing through the check valve 21 from the conduit 22 to the conduit 24.

FIG. 4 also shows the continuation of the conduit 24 that is provided by bore 80 in the integral block 30. The conduit 24 penetrates the transverse surface of the integral block 30 in order to establish a fluid passageway to the interior of the pneumatic cylinder 23.

In FIG. 2, the pneumatic cylinder 23 is shown with a transversely mounted piston 80 that is secured to a longitudinally disposed piston rod 81. According to a salient feature of the invention, a longitudinal bore 82 is formed in the piston rod 81. Although it is out of the plane of the drawing in FIG. 2, the conduit 24 as it emerges from the transverse surface the integral block 30 is in registry not only with the abutting transverse surface of the piston 80 but also is in fluid communication with the longitudinal bore 82 in the piston rod 81.

The piston 80 and the piston rod 81 affixed to the piston 80 are capable of longitudinal reciprocating movement within a chamber 83 in the pneumatic cylinder 23. This longitudinal movement produces a line of action or force that coincides with a longitudinal axis 84 of the cylinder 23.

The longitudinal bore 82 terminates at the extreme end of the piston rod 81 in fluid communication with a small transverse bore 85.

A retaining ring 86 seated in a groove formed in the internal surface of the pneumatic cylinder 23 separates the chamber 83 from a chamber 87. Within the chamber 87 a transversely disposed partition 90 is braced against the retaining ring 86. A centrally disposed aperture in the partition 90 provides a journal for the end of the piston rod 81, which rod protrudes slightly beyond the partition 90 and into the chamber 87.

The transverse end of the piston rod 81 abuts another piston rod 91 in order to provide a small longitudinal clearance between the partition 90 and a piston 92. This clearance between the piston 92 and the partition 90 is in fluid communication with the conduit 24 by way of the bores 82 and 85. In these circumstances, and in accordance with an aspect of the invention, pneumatic fluid discharging from the conduit 24 in the integral block 30 acts upon both of the pistons 80 and 92, driving these pistons and their associated piston rods 81 and 91 to the observer's right as viewed in FIG. 2 of the drawing. Air is exhausted from the chamber 87 through the bores 85 and 82 and the conduit 24. Air in the chamber 83, however, is discharged directly through the conduit 24 (not shown in FIG. 2).

To complete the structural description of the valve system, attention is invited to FIG. 6 which shows the regulator valve 26 and an air or pneumatic fluid filter 93. Air, or other suitable working fluid, enters the conduit 25 under pressure from a supply source (not shown). The conduit 25 is formed through a bore 94 in the plate 32, a bore 95 in the plate 31 and a bore 96 in the integral block 30. The bore 95, moreover, accommodates the filter 93. As shown, the filter 93 has a screen or cylindrical foraminous member 97 through which all air entering the conduit 25 must flow before it enters the regulator valve 26.

The regulator valve 26 is accommodated in a housing that is formed by three axially aligned bores 100, 101 and 102 in the plates 32, 31 and the integral block 30, respectively. An adjusting screw 98 is threaded into the bore 100. A knob 103 on the screw 98 protrudes from the bore 100 beyond the transverse end of the plate 32. The knob 103 permits adjustment to the compression that is applied to a coil spring 104 which is lodged within the bore 100. As illustrated, the spring 104 is positioned between the end of the adjusting screw 98 and a diaphragm follower spring seat 105.

A transversely disposed diaphragm 99 is clamped between the plates 31 and 32 at their common interface. The diaphragm 99 extends across the bore 100 and effectively separates the bore 100 from the bore 116. An annular corrugation also is formed in the diaphragm 99. This corrugation is interposed in the gap between the diaphragm follower 105 and the immediately adjacent surface of the bore 100.

A further valve stem 106 is lodged within the bore 116. A flat head 107 formed on one end of the valve stem 106 bears against the diaphragm 99 under the force applied by a conical spring 110 that is received on the valve stem 106 between the flat head 107 and a shoulder that is formed in the bore 116. The bore 101 provides a bearing to guide the valve stem 106. A small cavity 111 formed in the terminal portion of the valve stem 106 forms a seat at the interface between the valve stem 106 and the valve element 113. This terminal portion of the valve stem 106, moreover, passes through the central aperture of valve seat 112 that is sealably lodged in the bore 101 at the plane of common intersection between the plate 31 and the integral block 30.

As seen in FIG. 6, the aperture in the valve seat 112 is spaced from the adjacent portion of the valve stem 106 to provide an air passageway through which communication is established through valve 17 (FIG. 5) with the interior of the pneumatic cylinder 23 (not shown in FIG. 6) by way of the conduits 27, 22, and 24. Within the bore 102 the further valve element 113 is biased against the end of the valve stem 106 that accommodates the cavity 111 by means of a coil spring 114. The flat face of the valve element 113 that abuts the valve stem 106 has a slightly greater diameter than the diameter of the corresponding aperture in the valve seat 112. In this way, depending on the relative longitudinal position of the flat face on the valve element 113 vis-a-vis the seat 112, air pressure is regulated proportional to load provided by spring 104.

Further with respect to the valve element 113, a longitudinal bore 115 extends the entire length of the element 113 and is in alignment with the cavity 111 on the end of the valve stem 106.

In operation, as best shown in FIG. 1, a brief pulse of compressed air is admitted to the conduit 10 through the activation of a valve (not shown) mounted on or adjacent to the jamb of the door (also not shown) to be opened automatically. Thus, a slight initial manual pressure on the door valve is sufficient to produce a pulse that will commence automatic operation. This initial compressed air pulse essentially bypasses the choke 12 and flows through the check valve 11 to the conduit 13 and the pressure accumulator 14.

Proceeding from the pressure accumulator 14 by way of the conduit 15, the pulse activates the pilot valve 16. In activating the pilot valve 16, and as most clearly shown in FIG. 5, the pilot valve stem 57 shifts to the observer's left, as viewed in the drawing. This movement of the valve stem 57, in turn, presses the control valve stem 63 also to the observer's left.

By shifting the control valve stem 63 to the left, fluid communication is established through a path from the compressed air supply (not shown in the drawing) which, preferably provides the desired quantity of compressed air at not less than 20 psi, through the conduit 25 (FIG. 1), the filter 93, the pressure regulator valve 26, the conduit 27, past the flat head 65 (FIG. 5) of the control valve stem 63, through the conduit 22 (FIG. 1) and the choke 20 to both chambers 83 and 87 (FIG. 2) of the pneumatic cylinder 23 by way of the conduit 24 (FIG. 4).

In accordance with another feature of the invention, the regulator valve 26, as shown in FIG. 1 is subject only to air flow in one direction, i.e. from the filter 93 toward the pneumatic cylinder 23. This relative position of the pressure regulator valve 26 in the system increases valve life and decreases wear on this delicate component. Consequently, the durability and cycle life of the entire system is improved significantly because of this important component relocation.

Within the pressure regulator valve 26, as shown more clearly in FIG. 6, the application of a proper degree of compressive force on the coil spring 104 by turning the knob 103 to insert or withdraw the control valve stem 98 into or out of the bore 100 causes the valve stem 106 to reduce the supply pressure of the compressed air from the filter 93 to some predetermined value. Preferably, it has been found that a pressure range of 3 to 100 psi is adequate for most purposes. The pressure output from the pressure control valve 26 is generally determined by the force that is required of the pneumatic cylinder 23 (not shown in FIG. 6) to swing open the door in question. This force must be slightly greater than closing force applied not only by the weight of the door, but also by the door closer apparatus (also not shown in the drawing).

Turning now to FIG. 4, it can be seen that the compressed air from the pressure regulator valve 26 (FIG. 6) flows through the conduit 22, past the choke setting that the conical frustrum 74 establishes with the adjacent portion of the choke housing 72 and into the conduit 24. Manipulation of the slotted head 73 adjusts the gap between the conical frustrum 74 and the choke housing 72 to provide a desired door opening speed, in accordance with the needs of a particular door opener application.

Looking now at FIG. 2, compressed air from the conduit 24 (not shown in FIG. 2) is applied directly to the piston 80 and indirectly by way of the bores 82 and 85 to the piston 92. This influx of compressed air drives the pistons 80, 92 to the observer's right as viewed in the drawing. Both of the piston rods 81 and 91 move to the right, pressing the door in question open all of the way without any further expenditure of manual effort.

After the door has been fully opened, a conventional door closing mechanism (not shown in the drawing) applies the usual force to press the door shut. In this instance, however, the door closing device must overcome the countervailing force applied by the pneumatic cylinder 23 (FIG. 2). Accordingly, the door closing force tends to expel the air from the chambers' 83, 87 by pressing the pistons 80, 92, respectively to the observer's left as viewed in the drawing.

The compressed air thus is forced out of the chamber 87 by way of the bores 85, 82 and the conduit 24 as, at the same time, compressed air is forced out of the chamber 83 directly through the conduit 24. As shown in FIG. 1, this discharging air effectively bypasses the choke 20 by flowing through the check valve 21 to the conduit 22. In this situation, the control valve 17 has been reset to permit the discharging air to flow directly into the atmosphere by way of the conduit 22 (FIGS. 1 and 4) and the communicating bore 66 (FIG. 5) in the control valve stem 63. Thus, the door closes.

Naturally, the length of time during which the door will remain open is regulated through the setting on the choke 12 (FIG. 1). The greater the interval of time that a suitable pressure is applied to the pilot valve 16 through the pressure accumulator 14, the longer the control valve 17 will remain in a door open status and block the air in the pneumatic cylinder 23 from discharging to the atmosphere. This timed leakage of the air from the pressure accumulator is controlled by the setting on the choke 12. Turning to FIG. 7, it can be seen that this predetermined leakage rate is set by establishing a suitable clearance between the conical frustrum 43 on the end of the choke valve stem 40 and the adjacent portion of the choke housing 36.

The slender parallel arrangement of the pistons and the compact, generally trouble free integral assemblage of valves as a part of the pneumatic cylinder structure produces a small unit that can be covered with a small, eye-appealing and architecturally acceptable fairing (not shown in the drawing). In this manner, the invention overcomes a number of difficulties that have beset prior art devices.

I claim:

1. A pneumatic cylinder for producing a controlled piston rod reciprocation comprising, an integral block forming a transverse end of the pneumatic cylinder, a plurality of parallel plates overlaying said integral block and fastened sealably thereto, said integral block and said overlaying plates having a plurality of aligned bores formed therein, said bores forming valves and interconnecting conduits for said valves, at least one of said conduits establishing pneumatic communication between at least some of said valves and said pneumatic cylinder, two pistons within said pneumatic cylinder, each longitudinally spaced from the other, one of said pistons being disposed adjacent to said integral block and having a piston rod connected thereto, said piston rod having a longitudinal bore formed therein to establish pneumatic communication between said communicating conduit and said other piston, said other piston also being spaced from said integral block, a partition separating said pistons from each other being interposed therebetween in order to establish two separate chambers within said pneumatic cylinder, and two adjustable chokes in said valves one of said chokes regulating the speed with which the pneumatic cylinder piston rod moves in a first direction, the other of said chokes, regulating the length of time that the piston rod remains moved in said first direction.

2. A pneumatic cylinder according to claim 1 wherein, said chokes have slots in their ends protruding from the lateral side of said integral block and plate combination in order to facilitate access to said slots.

3. A pneumatic cylinder according to claim 2 further comprising a pair of check valves, each of said check valves being individual to a respective one of said chokes, said check valves bypassing said respective chokes during those times in which said chokes are to remain inoperative and compelling pneumatic fluid to flow through said chokes when said chokes are to control the piston rod motion.

4. A pneumatic cylinder according to claim 3 further comprising a control valve interposed between said check valves and in fluid communication therewith, and a pressure regulator valve in direct fluid communication with said control valve to enable fluid expelled from the cylinder to discharge through said control valve by way of one of said check valves.

* * * * *